US008453272B2

(12) United States Patent
Sim

(10) Patent No.: US 8,453,272 B2
(45) Date of Patent: Jun. 4, 2013

(54) AUTOMATIC CLEANING ASSEMBLY FOR A TOILET BOWL

(76) Inventor: Jae K. Sim, Rancho Cucamonga, CA (US)

( * ) Notice: Subject to any disclaimer, the term of this patent is extended or adjusted under 35 U.S.C. 154(b) by 479 days.

(21) Appl. No.: 12/250,908

(22) Filed: Oct. 14, 2008

(65) Prior Publication Data

US 2010/0088810 A1 Apr. 15, 2010

(51) Int. Cl.
*E03D 9/00* (2006.01)

(52) U.S. Cl.
USPC ..... 4/225.1

(58) Field of Classification Search
USPC . 4/225.1, 222, 1, 226.1, 227.1, 231; 239/310, 239/311; 222/630, 318, 424; 137/268
See application file for complete search history.

(56) References Cited

U.S. PATENT DOCUMENTS

| | | | | |
|---|---|---|---|---|
| 4,312,082 | A | 1/1982 | Murphy et al. | |
| 4,901,755 | A | 2/1990 | Rodstein | |
| 5,152,015 | A * | 10/1992 | Fourman | 4/225.1 |
| 5,673,439 | A | 10/1997 | Kuo | |
| 5,778,459 | A | 7/1998 | Guerin | |
| 6,321,392 | B1 | 11/2001 | Sim | |
| 6,449,779 | B1 | 9/2002 | Nguyen | |
| 6,662,379 | B2 | 12/2003 | Nguyen et al. | |
| 6,944,890 | B1 | 9/2005 | Sim | |
| 7,007,312 | B1 | 3/2006 | Sim | |
| 2007/0136937 | A1 * | 6/2007 | Sawalski et al. | 4/223 |

OTHER PUBLICATIONS

Search Report and Written Opinion for PCT/US2009/058880.
Church & Dwight Co., Inc. "Never Scrub" Continuous Toilet Cleaning System. http://www.kaboomkaboom.com/product.m?sku=135096A00.

* cited by examiner

*Primary Examiner* — Gregory Huson
*Assistant Examiner* — Janie Christiansen
(74) *Attorney, Agent, or Firm* — Stetina Brunda Garred & Brucker

(57) ABSTRACT

An automatic cleaning assembly having an outer body and an inner lid which, when attached to each other, may define an inner chamber and an outer chamber. Refill water may enter the inner chamber through a fluid flow path of an inlet. A cleaning agent disposed within the inner chamber may be partially dissolved upon contact with the water. The water with the dissolved cleaning agent begins to fill the outer chamber and exit out of the outlet of the automatic cleaning assembly. The outlet of the automatic cleaning assembly is positioned above the inlet of the automatic cleaning assembly such that water is retained within the outer chamber to prevent gas caused by the cleaning agent from escaping into the environment. Moreover, the automatic cleaning assembly may have a check valve to prevent water from back flowing into a ball cock of the toilet.

14 Claims, 5 Drawing Sheets

AUTOMATIC CLEANING ASSEMBLY FOR A TOILET BOWL

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

The present invention relates to an automatic cleaning assembly for providing a dissolved cleaning agent to a toilet bowl after each flush.

Several prior art systems exist for cleaning a toilet bowl. By way of example and not limitation, U.S. Pat. No. 7,007,312 (hereinafter '312 Patent) provides a device for automatically cleaning the toilet bowl of a toilet. Upon flushing the toilet, water within the toilet bowl is flushed to the sewer system. Refill water is then introduced into the toilet bowl. The refill water has a dissolved cleaning agent to assist in cleaning the toilet bowl after each use. The device of the '312 Patent delays the introduction of refill water containing the dissolved cleaning agent into the toilet bowl until the contaminated toilet bowl water has been ejected out of the toilet bowl. The dissolved cleaning agent is not wastefully introduced into the toilet bowl when contaminated water is being discharged into the sewer system. Less of the fresh dissolved cleaning agent is flushed out with the contaminated toilet bowl water. Accordingly, the device of the '312 Patent delays the introduction of water with the dissolved cleaning agent until the optimal time to conserve the cleaning agent and extend the life of the cleaning assembly.

Another ingenious system is described in U.S. Pat. No. 6,321,392. This system extends the life of the cleaning agent by insuring that a level of the water in contact with the cleaning agent remains low to slowly dissolve the cleaning agent. This also conserves the cleaning agent thereby extending the life of the cleaning assembly.

There exists a need in the art for further improvements in automatic cleaning assemblies for providing dissolved cleaning agent to a toilet bowl after each flush.

BRIEF SUMMARY OF THE INVENTION

The automatic cleaning assembly discussed herein addresses the needs above, those discussed below and those that are known in the art. The automatic cleaning assembly may have an inner chamber and an outer chamber. After each flush, water may be retained within the outer chamber to prevent harmful gas produced by the cleaning agent within the inner chamber from escaping out of the automatic cleaning assembly. Moreover, the inlet of the automatic cleaning assembly may have a check valve or water trap opening to divert back flow water back into the automatic cleaning assembly instead of back into the refill tube and the fill valve of the toilet.

The automatic cleaning assembly discussed herein may be installed in a toilet. The automatic cleaning assembly cleans a toilet bowl with water diluted with a cleaning agent. The assembly may comprise a body, a lid and check valve. The body may include an inlet for receiving water and an outlet for dispensing water diluted with the cleaning agent. The body may define an internal cavity.

The lid may seal the internal cavity of the body. The lid may also have a wall structure defining an inner chamber. The wall structure may divide the internal cavity of the body between the inner chamber and an outer chamber. The outer chamber is defined by the wall structure of the lid and the body. The inner and outer chambers may be in fluid communication with each other at a lower portion of the inner and outer chambers. The inlet of the body may be in direct fluid communication with the inner chamber of the lid. For example, it is contemplated that a terminal end of the inlet of the body may terminate within the inner chamber of the lid.

The check valve may provide fluidic communication between the inlet and the outer chamber for preventing back flow of water. The check valve may be positioned above the inlet of the body or upstream of the inlet of the body. The check valve may be smaller than the inlet so as to have a lower flow rate compared to the inlet of the body.

The cleaning agent may be disposed within the inner chamber of the lid. The cleaning agent may be retained within the inner chamber of the lid with a screen.

The automatic cleaning assembly may have its outlet positioned at an upper portion of the body. In this manner, water may be siphoned out of a connecting tube connecting the outlet and the overflow pipe of the toilet.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION OF THE INVENTION

Figure 1:
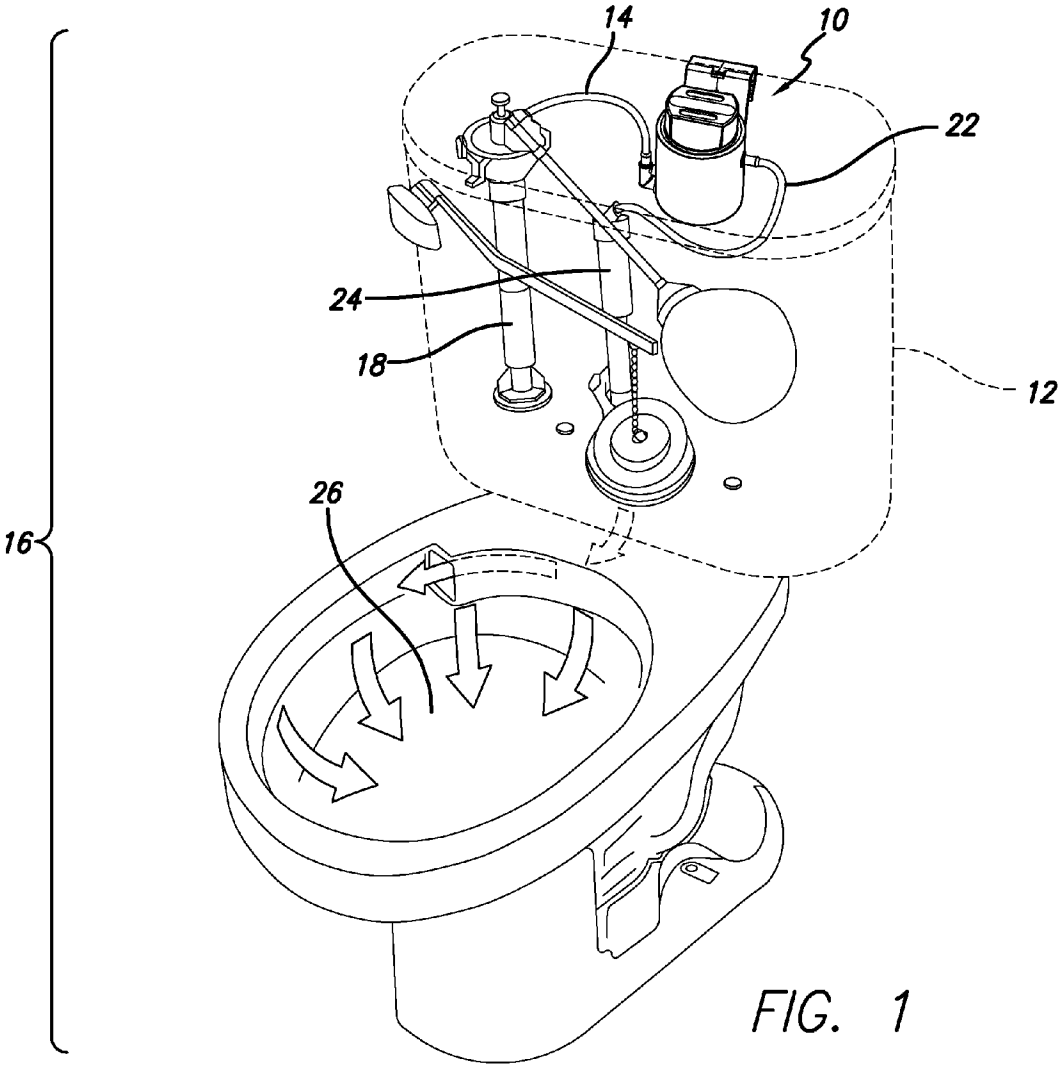
FIG. 1 is a perspective view of an automatic cleaning assembly installed in a water holding tank of a toilet.

Referring now to FIG. 1, an automatic cleaning assembly 10 is shown as installed in a water holding tank 12 of a toilet 16. The automatic cleaning assembly 10 is attached to a fluid inlet line or refill tube 14. When the user flushes the toilet 16, water flows from the fill valve 18 and enters the automatic cleaning assembly 10 via the refill tube 14. The water dissolves a portion of a cleaning agent 20 (see FIG. 2) disposed within the automatic cleaning assembly 10. The dissolved cleaning agent 20 and water flows out of the automatic cleaning assembly 10 through a connecting hose 22 to the overflow pipe 24 and into the toilet bowl 26.

Figure 2:
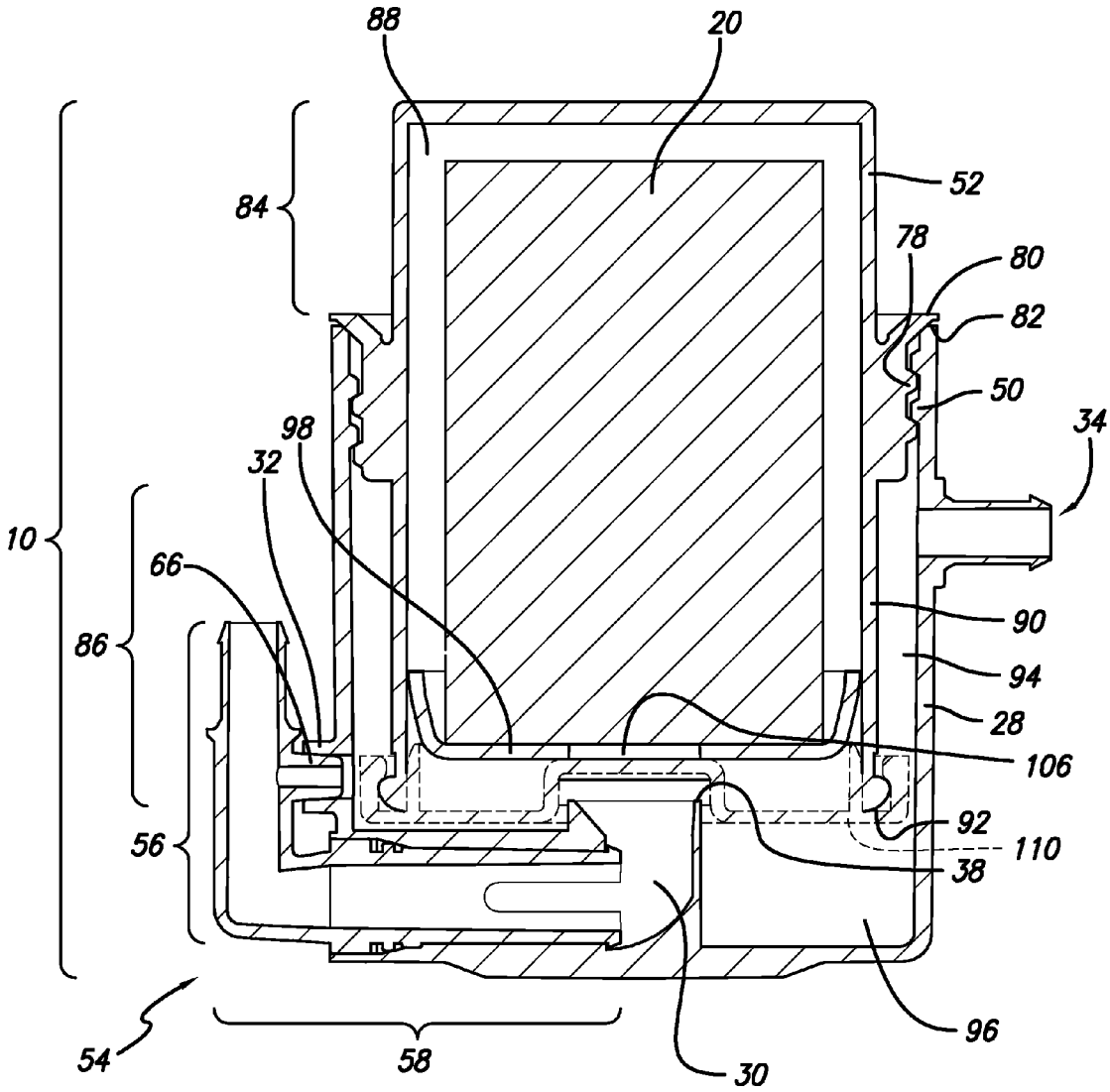
FIG. 2 is a cross sectional view of the automatic cleaning assembly shown in FIG. 1.
Figure 3:
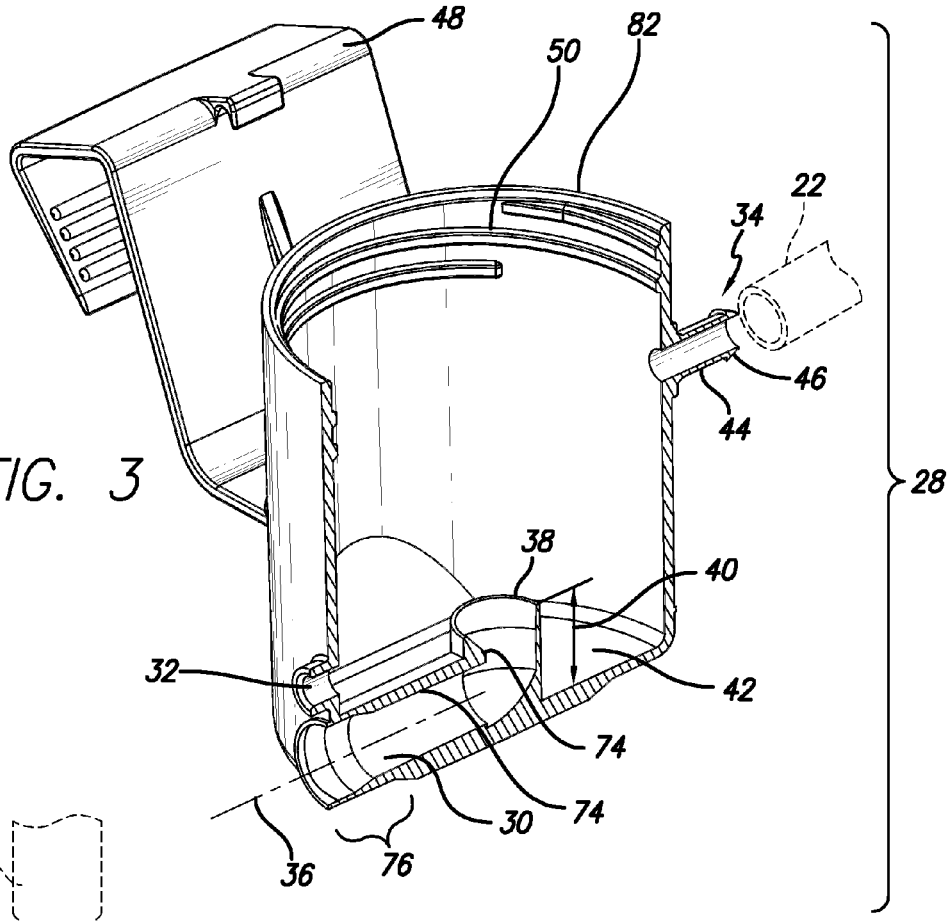
FIG. 3 is a perspective cross sectional view of a body of the automatic cleaning assembly shown in FIG. 1.

Referring now to FIGS. 2 and 3, the automatic cleaning assembly 10 may include a body 28. The body 28 may have a generally cylindrical side wall structure which is attached to and extends upwardly from a generally circular bottom wall, as shown in FIG. 3. It is also contemplated that the body 28 may have other configurations such as triangular, square, oval, etc. The body 28, as shown in FIG. 3, may have an inlet 30, a check valve inlet or diverter inlet 32, and an outlet 34. The inlet 30 may be disposed at a lower portion of the body 28 and may provide a fluid flow path 36 which extends centrally inward from the cylindrical wall structure then upward from the central portion or axis of the body 28. The inlet 30 may have a terminal end 3S which terminates at a height 40 above the bottom surface 42 of the body 28. The inlet 30 of the body 28 may be sufficiently large to provide substantially unimpeded flow of water from the refill tube 14 (see FIG. 1).

The check valve inlet 32 may be disposed generally above the inlet 30. The check valve inlet 32 may have an inner diameter which is substantially smaller than the inner diameter of the inlet 30 of the body 28. The check valve inlet 32 and the inlet 30 of the body 28 may be both in fluid communication with the refill tube 14, as shown in FIG. 1. The refill tube 14 may be directed generally upward when installed, as also shown in FIG. 1. As water flows through the refill tube 14 upon flushing of the toilet, the water may primarily enter the body 28 through the inlet 30. When water ceases flowing through the refill tube 14, the check valve inlet 32 prevents water from back flowing from the inlet 30 to the refill tube 14 and back to the fill valve 18 (see FIG. 1). As discussed above, the automatic cleaning assembly 10 contains a cleaning agent 20. Once the water enters the automatic cleaning assembly 10, back flow water to the fill valve 18 may damage the fill valve 18 and other equipment of the toilet 16 due to the dissolved cleaning agent 20 in the backflow water. The water attempting to backflow into the fill valve 18 from the inlet 30 instead is diverted into the check valve inlet 32 back into the body 28.

The outlet 34 (see FIG. 3) may comprise a tubular section 44 with a barb 46. The outlet 34 of the body 28 may be located higher than the check valve inlet 32. In particular, the outlet 34 of the body 28 may be generally located at the upper half portion of the body 28. More preferably, the outlet 34 may be located as high up on the body 28 as possible. The connecting hose 22 may be slipped over the tubular projection 44. The connecting hose 22 may have a tight fit over the tubular projection 44 and the barb 46 for providing a generally fluid seal there between. The barb 46 may prevent the connecting hose 22 from slipping off of the tubular projection 44. The connecting hose 22 may be directed generally downward, as shown in FIG. 1.

The body 28 may additionally have a hanger 48 for hanging the automatic cleaning assembly 10 over an edge of the toilet water holding tank 12 as shown in FIG. 1. The body 28 may additionally include internal threads 50 (see FIG. 3) for securing a lid 52 (see FIGS. 2 and 5) to the body 28.

Figure 4:
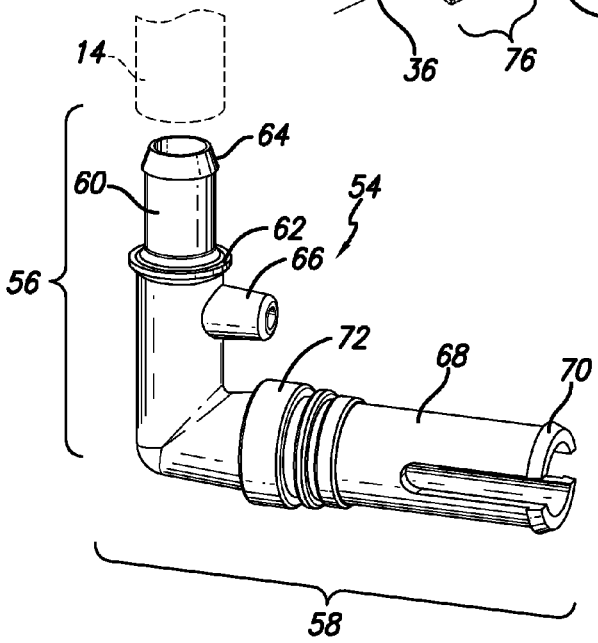
FIG. 4 is a perspective view of an elbow of the automatic cleaning assembly shown in FIG. 1.

As shown in FIG. 2, the refill tube 14 (see FIG. 4) may be connected or in fluid communication with inlet 30 of the body 28 and the check valve inlet 32 of the body 28 with an elbow 54. As shown in FIG. 4, the elbow 54 may have a first portion 56 and a second portion 58. The first and second portions 56, 58 may be generally perpendicular to each other. The first portion 56 may have a tubular projection 60 with a lip 62 and a barb 64. The refill tube 14 may be sized and configured relative to the tubular projection 60 and the barb 64 so as to have a tight fit there over. The tight fit provides a fluid seal between the refill tube 14 and the tubular projection 60. Once the refill tube 14 is slipped over the tubular projection 60, the barb 64 prevents the refill tube 14 from slipping off of the tubular projection 60. The terminal end of the refill tube 14 bumps up against the radially extending lip 62 to prevent the tubular projection 60 from being inserted too far into the refill tube 14.

The first portion 56 of the elbow 54 may additionally have a check valve outlet or diverter outlet 66. When water flows from the fill valve 18 through the refill tube 14 and into the body 28, the check valve outlet 66 is located upstream of the second portion 58 and also upstream of the inlet 30 of the body 28. The second portion 58 and the check valve outlet 66 may be sized and configured to cooperatively engage the inlet 30 (see FIG. 3) of the body 28 and the check valve inlet 32 of the body 28, respectively. In particular, the second portion 58 may be initially inserted into the inlet 30 of the body 28. The second portion 58 may have a split tubular projection 68 with a barb 70 and a ring shaped projection 72. As the seqond portion 58 is inserted into the inlet 30 of the body 28, the barb 70 (see FIG. 4) may catch an edge 74 (see FIG. 3) of the inlet 30 to prevent the second portion 58 of the elbow 54 from dislodging out of the inlet 30 during use (see FIG. 2). Moreover, the ring shaped projection 70 may be frictionally wedged into the proximal portion 76 (see FIG. 3) of the inlet 30 to further prevent the second portion 58 (see FIG. 4) of the elbow 54 from dislodging out of the inlet 30. Simultaneously, the check valve outlet 66 (see FIG. 4) may be frictionally wedged into the check valve inlet 32 (sec FIG. 3) of the body 28. When water flows through the refill tube 14 upon flushing, the water primarily enters the body 28 through the second portion 58 and the inlet 30. The water is directed upward where the cleaning agent 20 may be disposed (see FIG. 2). After water ceases to flow through the refill tube 14 from the fill valve 18, the dissolving cleaning agent 20 produces gas within the body 28. The gas may force the water to be pushed down, thus causing the chemically treated water to back flow through the terminal end 38 of the inlet 30 of the body 28 and further through the second portion 58 of the elbow. As the water back flows, the back flowing water is diverted back into the body 28 through the check valve outlet 66 formed on the first portion 56 of the elbow 54 and into the check valve inlet 32 of the body 28. Water does not back flow into the refill tube 14 and back into the fill valve 18. Such back flowing water containing dissolved cleaning agent 20 may harm the fill valve 18 or other toilet equipment.

Figure 5:
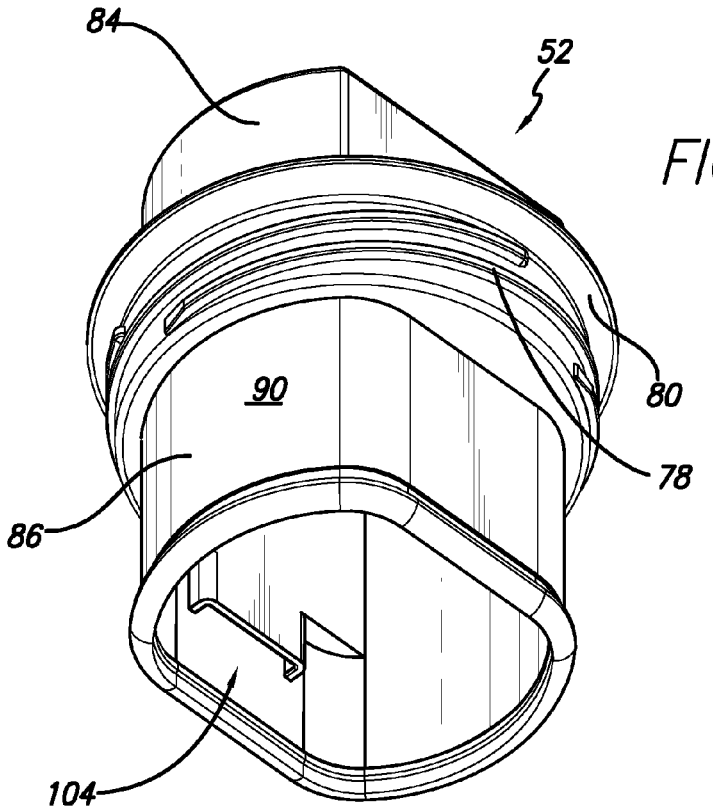
FIG. 5 is a bottom perspective view of a lid of the automatic cleaning assembly shown in FIG. 1.

The lid 52 may have external threads 78, as shown in FIG. 5. The external threads 78 of the lid 52 may engage with the internal threads 50 (see FIG. 3) of the body 28 (see FIG. 2). As the lid 52 is screwed into the body 28, a lip 80 may contact an upper end or upper rim 82 of the body 28 to prevent further insertion of the lid 52 into the body 28, as shown in FIG. 2. The lid 52 may comprise an upper projection 84 and a lower projection 86, as shown in FIG. 5. As shown in FIG. 2, the upper and lower projections 84, 86 partially define an inner chamber 88 that continuously extends from the upper projection 84 to the lower projection 86. The lower projection 86 may define a tubular wall structure 90 (see FIG. 2). The tubular wall structure 90 may have a lower distal end 92 which is positioned at a lower elevation compared to the terminal end 38 of the inlet 30 or at an elevation below height 40 (see FIG. 3). In this manner, refill water may flow directly into the inner chamber 88. The tubular wall structure 90 of the lower projection 86 of the lid 52 may be smaller or narrower than the body 28, as shown in FIG. 2. There may be a gap between the tubular wall structure 90 and the body 28. This gap defines an outer chamber 94. Upon flushing, water flows through the inlet 30 up into the internal chamber 88. Due to the force of water from the fill valve 18, the chemically treated water then flows downward into a connecting chamber 96. The connecting chamber 96 connects the inner and outer chambers 88, 94. The water level rises in the outer chamber 94 and exits out of the outlet 34 of the body 28 into the overflow pipe 24.

The cleaning agent 20 may be disposed within the inner chamber 88 of the lid 52, as shown in FIG. 3. The cleaning agent 20 may be held up above the terminal end 38 of the inlet 30 with a screen 98 (see FIG. 6), as shown in FIG. 2. Thus, the combination of the lid 52, screen 98 and cleaning agent 20 effectively create a "cleaning cartridge" of the cleaning assembly 10.

Figure 6:
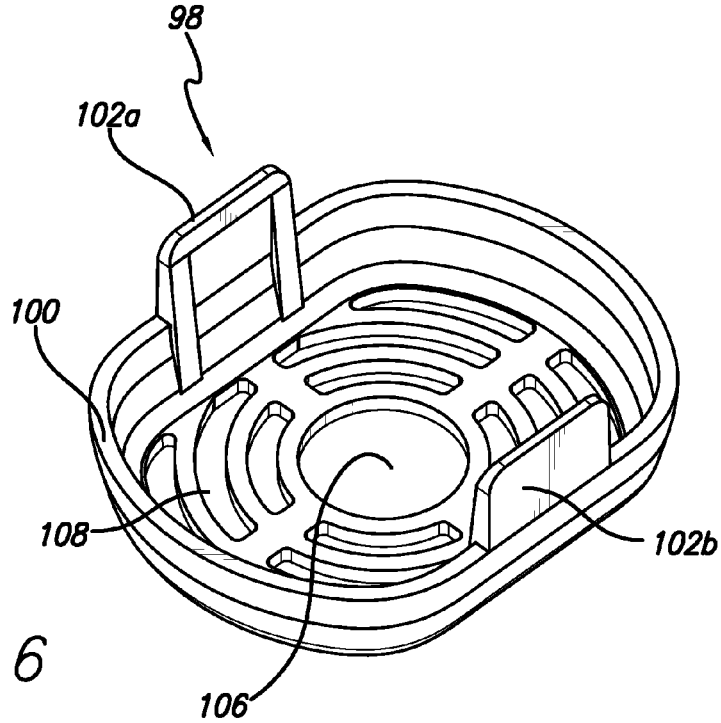
FIG. 6 is a top perspective view of a screen of the automatic cleaning assembly shown in FIG. 1.

Referring now to FIGS. 5 and 6, the screen 98 may have an outer periphery 100 which generally matches the inner periphery of the tubular wall structure 90 of the lower projection 86 of the lid 52. As shown in FIG. 6, the screen 98 may have two press fit ribs 102*a*, 102*b* that extend from the outer periphery 100. These press fit ribs 102*a*, 102*b* extend into respective, complimentary receptacles 104 formed internally on the tubular wall structure 90 shown in FIG. 5. The press fit ribs 102*a*, 102*b* may be frictionally wedged into the receptacles 104 to hold the screen 98 in position within the inner chamber 88, as shown in FIG. 2. The screen 98 may have a central aperture 106 that is generally aligned to the terminal end 38 of the inlet 30 of the body 28. The screen 98 may additionally have a matrix of apertures 108. Upon flushing of the toilet 16, water flows through the inlet 30 and out of the terminal end 38. The water is projected upward into the inner chamber 88 and contacts the cleaning agent 20 disposed above the screen 98 and within the inner chamber 88. A portion of the cleaning agent 20 is dissolved upon contact with the water so as to form a solution of water and cleaning agent 20. The water and cleaning agent 20 solution proceeds to the connecting chamber 96 via the apertures 108 of the screen 98. As the water continues to flow, the solution of cleaning agent 20 and water rises within the outer chamber 94 until it reaches and flows out of the outlet 34 of the body 28 and hence into the overflow pipe 24 via the connecting hose 22. During this stage, water remains within the inner chamber 88, which is substantially filled with water. When the valve 18 stops providing water through the refill tube 14, the water in the connecting hose 22 is siphoned into the overflow pipe 24 (see FIG. 1). Water is retained in the outer chamber 94 as well as in the inner chamber 88, though the water level in the inner chamber 88 may drop therein. Gas is typically produced in the inner chamber 88 due to the contact of the cleaning agent 20 with the water. The production of gas in the inner chamber 88 pushes the water level in the inner chamber 88 downward. The water in the inner chamber 88 tends to back flow into the inlet 30 and the second portion 58 of the elbow 54 (see FIG. 4). The water back flows up the first portion 56. Fortunately, the back flowing water is diverted back into the outer chamber 94 through the check valve outlet 66 of the elbow 54 and the check valve inlet 32 of the body 28. The check valve outlet 66 and the check valve inlet 32 may be collectively referred to as a check valve.

In an aspect of the automatic cleaning assembly 10, the outlet 34 of the body 28 may be positioned high up on the body 28, as discussed previously. When the fill valve 18 ceases to supply water to the automatic cleaning assembly, water within the connecting hose 22 is siphoned into the overflow pipe 24 as indicated above. However, water always remains within the outer chamber 94 at a level slightly below the outlet 34 to prevent gas formed in the inner chamber 88 from escaping out of the automatic cleaning assembly 10. In this regard, the water remaining in the outer chamber 94 acts as a vapor barrier, thus preventing the gas from escaping into the toilet bowl 26 via the connecting hose 22. The gas produced by the cleaning agent 20 may be unpleasant to users and other personnel in the general vicinity. Fortunately, such gas remains in the inner chamber 88.

Figure 7:
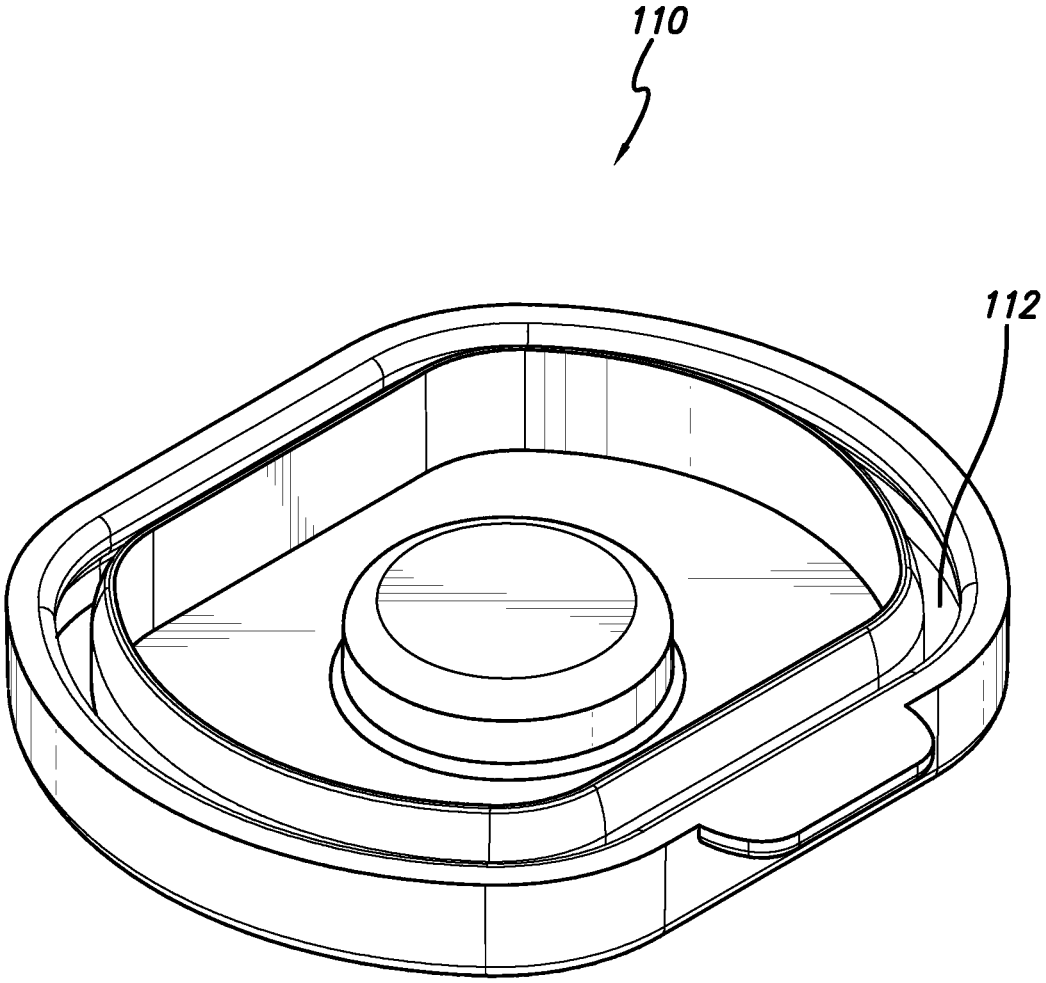
FIG. 7 is a top perspective view of a cap of the automatic cleaning assembly shown in FIG. 1.

Prior to installation of the automatic cleaning assembly 10 in a toilet 16, as shown in FIGS. 2 and 7, a cap 110 may be disposed over the lower distal end 92 of the tubular wall structure 90 of the lower projection 86 of the lid 52. The cap 100 is shown in phantom lines in FIG. 2 because the cap 110 is removed when the assembly 10 is installed. The cap 110 may have a trench 112 that may be sized and configured to fit over the lower distal end 92 of the lid 52. The cap 110 may fit over the lower distal end 92 of the lid 52 and provide a general seal such that the odor of the cleaning agent 20 does not escape of out of the inner chamber 88 while the automatic cleaning assembly 10 is in storage.

The cleaning agent 20 may be provided in a solid form, and typically comprises pellets or tablets. The cleaning agent may be operative to dissolve upon contact with water. Also, the cleaning agent may be any type of cleaning agent known in the art such as chlorine tablets or blocks or a cleaning agent developed in the future. The present invention is not intended to be limited to any particular form of the cleaning agent 20.

The above description is given by way of example, and not limitation. Given the above disclosure, one skilled in the art could devise variations that are within the scope and spirit of the invention disclosed herein, including various ways of forming the inner and outer chambers. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An automatic cleaning assembly for periodically dispensing water diluted with a cleaning agent into a toilet bowl of a toilet, the cleaning assembly comprising:

a body having:

a bottom wall;

a side wall attached to the bottom wall and defining an upper rim;

an inlet for receiving water; and an outlet for dispensing water diluted with the cleaning agent;

a lid cooperatively engaged to the body, the lid and body collectively defining an internal cavity consisting essentially of a first chamber, a second chamber and a connecting chamber fluidly connecting the first and second chambers, the inlet extending through the body and into fluid communication with the first chamber at a first location adjacent a lower portion or the first chamber, and the outlet extends through the side wall an into fluid communication with the second chamber at a location which is elevated above the first location and is disposed between the inlet and the upper rim; and a diverter including a diverter inlet which extends through the side wall into fluid communication with a second chamber between the inlet and the outlet.

2. The cleaning assembly of claim 1 wherein the first chamber is at least partially defined by the lid, and the second chamber is at least partially collectively defined by the lid and the body.

3. The cleaning assembly of claim 2 wherein the first chamber is circumvented by the second chamber.

4. The cleaning assembly of claim 1 wherein the inlet is fluidly connected to a fluid inlet line via an elbow having a first portion which is connected to the fluid inlet line and a second portion which is advanced into the inlet and fluidly communicates with the first chamber.

5. The cleaning assembly of claim 4 wherein the diverter further fluidly communicates with the first portion of the elbow.

6. The cleaning assembly of claim 1 wherein the first chamber is partially defined by a screen which is configured to maintain the cleaning agent in the first chamber and to facilitate fluid flow from the first chamber to the second chamber.

7. The cleaning assembly of claim 1 wherein the inlet defines a terminal end which is disposed between the connecting chamber and the outlet.

8. The cleaning assembly of claim 1 wherein the body further comprises a hanger for facilitating the releasable attachment thereof to the toilet.

9. The cleaning assembly of claim 1, wherein the body and lid are configured to collectively define a flow path from the inlet to the outlet wherein fluid flows radially outward.

10. An automatic cleaning assembly for use with an inlet tube for periodically dispensing water diluted with a cleaning agent into a toilet bowl of a toilet, the cleaning assembly comprising:

a body having:

a bottom wall;

a side wall attached to the bottom wall and defining an upper rim;

an inlet fluidly connectable with the inlet rube for receiving water; and an outlet for dispensing water diluted with the cleaning agent;

a lid having:

a continuous tubular wall structure;

the lid being cooperatively engaged to the body such that the lid and body collectively define an internal cavity including first and second chambers which are fluidly connected to each other, the first chamber being sized to receive the cleaning agent, the continuous tubular wall structure circumnavigating the first chamber when the lid is engaged with the body;

the inlet extending through the body into fluid communication with the first chamber at a first location and the outlet extending through the side wall into fluid communication with the second chamber at a second location elevated, from the first location and disposed between the inlet and upper rim; and a diverter operatively positioned between the inlet and the second chamber thr allowing fluid which backflows from the inlet to flow into the second chamber.

11. The cleaning assembly of claim 10 wherein the diverter includes a diverter inlet extending through the side wall into fluid communication with the second chamber between the inlet and the outlet.

12. The cleaning assembly of claim 11 wherein the inlet is fluidly connected to a fluid inlet line via an elbow having a first portion which is connected to the fluid inlet line and a second portion which is advanced into the inlet and fluidly communicates with the first chamber.

13. The cleaning assembly of claim 10 wherein the first chamber is partially defined by a screen which is configured to maintain the cleaning agent in the first chamber and to facilitate fluid flow from the first chamber to the connecting chamber.

14. The cleaning assembly of claim 10 wherein the inlet defines a terminal end which is disposed between the connecting chamber and the outlet.

* * * * *